US006130413A

United States Patent [19]

Rak

[11] Patent Number: 6,130,413

[45] Date of Patent: Oct. 10, 2000

[54] SAFETY DEVICE FOR ELECTRIC COOKING STOVE

[76] Inventor: Jozef Rak, 2274 Melton Ct., Mississauga, Ontario, Canada, L4Y 1M1

[21] Appl. No.: 09/263,482

[22] Filed: Mar. 8, 1999

Related U.S. Application Data

[60] Provisional application No. 60/027,683, Oct. 7, 1996.

[51] Int. Cl.[7] ..... H05B 1/02

[52] U.S. Cl. ..... 219/492; 219/519; 219/414; 219/506; 340/573; 340/655

[58] Field of Search ..... 219/518, 519, 219/492, 412–414, 497, 506; 340/529, 625, 640, 655, 573

[56] References Cited

U.S. PATENT DOCUMENTS 4,775,913 10/1988 Ekblad ..... 361/179
5,380,985 1/1995 Graham ..... 219/452
5,717,188 2/1998 Vaillancourt ..... 219/452

*Primary Examiner*—Mark Paschall
*Attorney, Agent, or Firm*—Ridout & Maybee

[57] ABSTRACT

A safety device for use in conjunction with an electric cooking stove includes a relay unit having a plug having two live pins and a neutral pin for insertion in a stove receptacle, a receptacle receiving a similar plug of a stove, a relay arrangement for interrupting connections between the live pins of the plug, and corresponding live sockets of the receptacle; and a control unit connected to the relay arrangements, the control unit generating signals to activate said relay arrangement; the relay arrangement is configured to interrupt only one at a time of the connections between the live pins and the live sockets, and the relay arrangement further includes preset switch or jumper to select which of said connections is interrupted. The control unit preferably includes a device to detect the presence of a person in the vicinity of the stove and a timer which restarts a count-down whenever the detection a device fails to detect a person, and causes the control unit to send a signal to the relay arrangements on completing the countdown.

11 Claims, 3 Drawing Sheets

SAFETY DEVICE FOR ELECTRIC COOKING STOVE

This application claims the benefit of provisional application No. 60/027,683, filed on Oct. 7, 1996.

FIELD OF THE INVENTION

REVIEW OF THE ART

This invention relates to safety devices for domestic cooking stoves.

Proposals have previously been made for systems which turn off a stove after a predetermined time in absence of operator activity in the vicinity of the stove. Thus U.S. Pat. No. 4,775,913 (Ekblad) proposes a device for use in conjunction with a stove which enables operation of a stove when a user is in the area, and temporarily disables the stove a predetermined time after the user leaves the area. Operation is automatically re-enabled when the user returns a first time; thereafter the user must reset the device on return.

U.S. Pat. No. 5,380,985 (Graham) proposes a device built into a stove to perform a generally similar function of disabling the stove when it is left unattended for more than a given period.

Canadian Patent Application no. 2,152,015 (Vaillancourt) discloses a device which may be either incorporated into or used in conjunction with a stove for detecting the absence of an operator and some other condition such as excessive heat, or the activation of a heating element, and in response cutting power to the stove. The specification suggests that heat output from the stove may be reduced rather than cut off, but no means of achieving this is disclosed.

Japanese Patent Publication No. 02279925 also discloses a device which detects both the presence of a user, and heat from the stove, and controls stove operation accordingly.

Devices which are built into a stove have the disadvantage that they can only practicably be installed as original equipment in a new stove. Furthermore, even some of the built in devices disclosed in the above patents share with the add-on devices the severe disadvantage that cutting off power to the stove (or even substantially reducing it) will disable or cause malfunction in the clocks or timers almost invariably incorporated in domestic cooking stoves. This may be the reason that, to the best of applicant's knowledge, no such device has met with commercial acceptance.

SUMMARY OF THE INVENTION

It is an object of the present invention to provide an external safety device for use with an existing electric cooking stove which is effective to temporarily disable the stove for example in the prolonged absence of an operator, but which does not interfere with auxiliary stove functions such as clocks. A review of domestic electric cooking stoves used in North America has indicated that all conventional stoves use a three wire (four wire including ground) electrical supply with two live and one neutral conductors. The heating elements of the stove are powered by the nominal 240 volt supply between the live conductors, while auxiliary functions such as clocks, etc. are powered at 120 volts nominal from a connection between either one of the live conductors and the neutral conductor.

The invention provides a safety device for use in conjunction with an electric cooking stove comprising a relay unit, the relay unit having a plug having two live pins and a neutral pin for insertion in a stove receptacle, a receptacle receiving a similar plug of a stove, a relay arrangement for interrupting connections between the live pins of the plug and corresponding live sockets of the receptacle; and a control unit connected to the relay unit, the control unit including means to activate said relay arrangement connection; the relay arrangement is configured to interrupt only one at a time of the connections between the live pins and the live sockets, and the relay unit further includes preset selection means to select which of said connections is interrupted. The control unit preferably includes means to detect the presence of a person in the vicinity of the stove and a timer which restarts a count-down whenever the detection means fails to detect a person, and causes the relay activation means to send a signal to the relay unit on completing the countdown.

The invention extends to a safety device for a cooking stove, comprising means to disable heating elements of the stove, a timer controlling the disablement means and operative to enable the latter after a preset interval, means to reset the timer to said preset interval, means operative to detect a person in the vicinity of the stove and connected to operate the resetting means, and switch means to enable and disable the resetting means, whereby the switch means selects one of two modes in which the device may operate, an automatic mode in which it will enable the disablement means said preset interval after the detection means sense to detect a person in the vicinity of the stove, and a manual mode in which it will turn off the stove after said preset interval.

Further features of the invention will become apparent from the following description of a preferred embodiment.

SHORT DESCRIPTION OF THE DRAWINGS

DESCRIPTION OF THE PREFERRED EMBODIMENT

Figure 1:
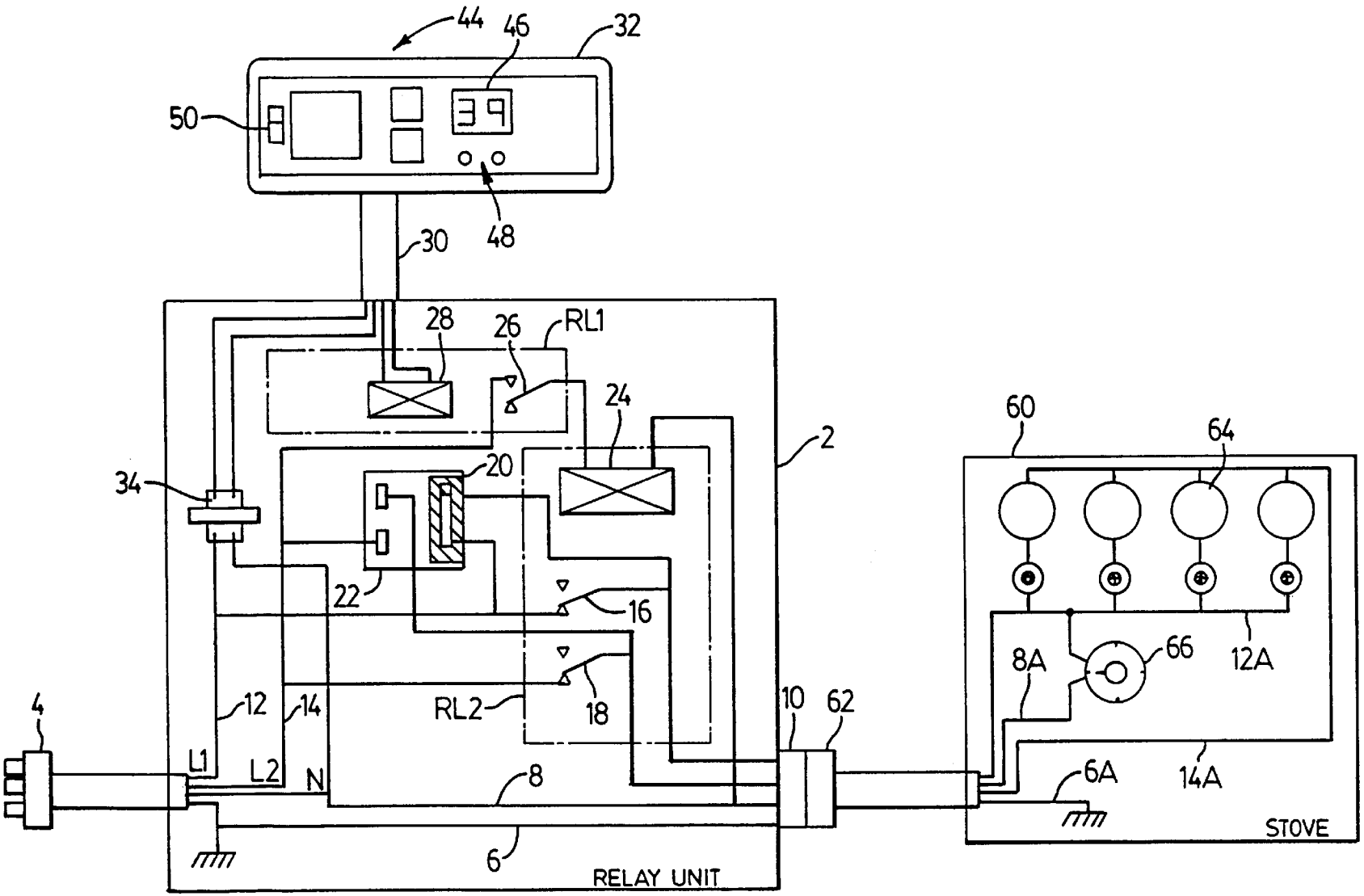
FIG. 1 is a schematic diagram of a presently preferred embodiment of device in accordance with the invention.
Figure 1A:
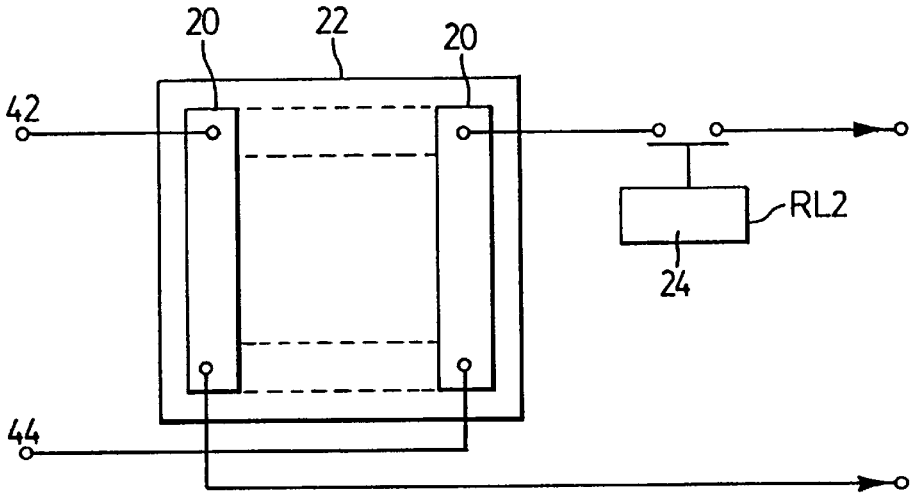
FIGS. 1A and 1B illustrate possible modifications of the device.

Referring to FIG. 1, a relay unit 2 has a plug 4 equipped with the usual four pins, namely two line connections, neutral and ground. The ground and neutral lines 6 and 8 are connected through to the corresponding sockets of a four pin receptacle 10, while the line connections 12 and 14 are connected through normally closed contacts 16 and 18 of a two pole relay RL2 to corresponding sockets of the receptacle 10. A shorting plug 20 on a jumper block 22 enables either of contacts 16 or 18 to be disabled, thus selecting which of line connections 12 and 14 will be broken when the relay RL2 is activated. It should be understood that a single pole relay 24 could be used in conjunction with additional plugs and a differently arranged jumper block to provide the same capabilities, as shown for example in FIG. 1A, in which shorting blocks 20 may be moved between the vertical positions shown, and horizontal positions shown in broken lines, to determine which line connection 12 or 14 is interrupted by the relay RLT which in this case has only a single pole. Additionally, the jumper block and plug could be replaced by a switch, although this would probably be more costly and is not really needed since the plug should only need to be moved only during initial set-up of the device as set forth below.

In view of the large current to be interrupted by the relay RL2, it is preferred to power the coil 24 of the relay through a low power pilot relay RL1, having single pole contacts 26 connected in series with the coil 24 between one of liens 12 and 14 and the neutral conductor 8. The coil 28 of pilot relay is connected through a flexible cable 30 to control unit 32; a transformer 34 in the relay unit also provides a low voltage current supply for the unit 32 through further conductors in the cable 30.

Figure 1B:
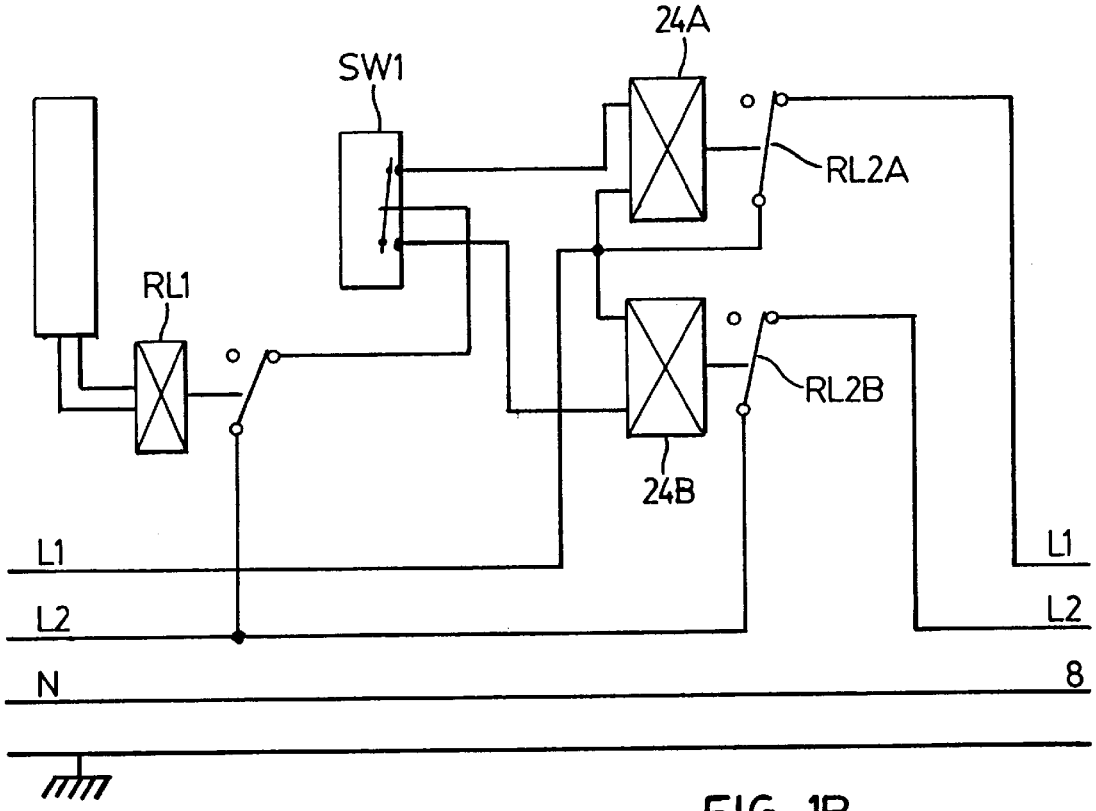

Any relay arrangement may be used that will permit either one of the connections established between the live pins and live sockets to be interrupted on receipt of an actuation signal, and any selection means may be used in place of the jumper block arrangement described that will enable selections of which connection is to be established. For example, as shown in FIG. 1B, each connection could be made through separate normally closed relays RL2A and RL2B, controlled by a relay RL1 which selectively operates one of the relays RL2A and RL2B, according to the position of a switch SW7 used to determine which relay is actuated. The switch is preferably located in the relay unit in place of the jumper block 22, but could be located in the control unit.

A stove 60 is equipped with a plug 62 which during usage of the device is plugged into the socket 10 so that live conductors 12A and 14A, neutral conductor 8A and ground conductor 6A within the stove are normally connected through the relay unit 2 to the plug 4. The stove is shown as having hot plates 64, and a clock/timer unit 66.

Figure 2:
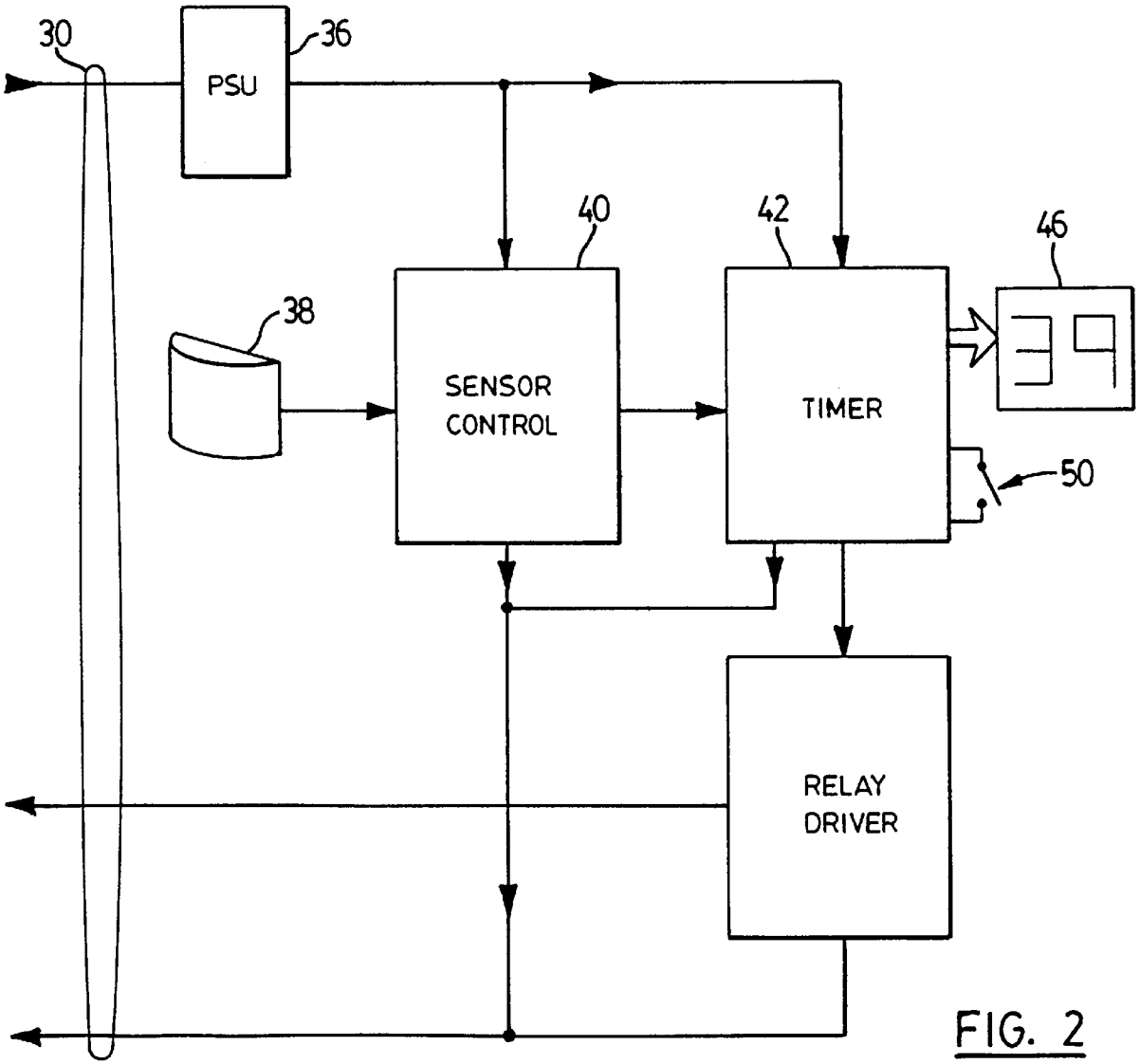
FIG. 2 is a block diagram of the control unit or console of FIG. 1.

Referring now to FIG. 2, the lower voltage supply from the cable 30 is rectified and smoothed by a power supply unit 36. A sensor 38, typically an infrared sensor having a wide horizontal and narrow vertical angle of view of the kind mass-produced and widely used in security systems to sense intruders, together with a control and sensing unit, also of conventional design, are powered by the power unit to sense the presence of persons in the vicinity of the stove 60, the control unit preferably being located on the stove, on a wall adjacent the store or under a cabinet, wherever it can monitor the vicinity of the stove and also be accessible to an adult user, although it should be high enough to be out of the reach of small children. A reasonably elevated position will also help prevent it responding to low level movements as of pets or small children. The control and sensing unit 40 provides an output to a retriggerable timer unit 42, which restarts a countdown whenever it fails to receive a signal from the sensing unit 40 indicating motion in the vicinity of a stove, or whenever a manual/auto switch 44 on the control unit is set to manual. As shown in the Figures, the timer is associated with a digital display 46 indicating the progress of the countdown, and also used to set the duration of the countdown. In the example shown, the maximum countdown is set to 39 minutes, but although a maximum delay of about 40 minutes is presently preferred, this should be regarded as exemplary only. Rather than using a digital display and press-button setting means 48 as shown, a rotary switch or other such means could be used to set the delay time, since it is cheaper and simpler to use, while the provision of the digital display 46 is optional. It should also be understood that a suitably programmed microcontroller could be used to provide the various control functions of the control unit 32. A switch 50 is provided to disable the control unit, for example by disabling the countdown timer unit 42 so that it never times out. This is preferred to turning off the unit 32 completely, since it enables a timer setting to be preserved when the unit is disabled.

Initial setup of the device may be achieved by plugging the relay unit 2 between a stove socket and the plug 62 of the stove 60 with the shorting plug 20 set to enable one of the live connections, and the time delay of the control unit set to zero of a low value. If, when the timer turns off the stove, the stove clock 66 continues to operate, no further action is needed. Otherwise, the relay unit is unplugged and the jumper set to its alternate position. Preferably the jumper is located so that it may only be accessed when the unit is unplugged. Once set up, opening of the contacts of relay RL2 will interrupt current to the hot plates 64, but not to the clock/timer unit 66.

In use, the control unit 32 is turned on using the switch 50. When the unit 32 is turned off, it has no effect on the operation of the stove 60 since the timer never times out and the contacts of the relays in the relay unit remain closed indefinitely. The timer is set to a desired delay using the setting means 48. Each time the motion detector detects motion, it resets the timer to the set delay, provided that the switch 44 is set to "auto". If the switch is set to manual, the timer resetting function is disabled, i.e. the stove is turned off after the preset delay, whether or not motion is detected. Each of the "on", "off", "manual" and "auto" conditions is indicated by a signal light such as LEDs 52, 54, 56 and 58.

Various modifications of the device are possible within the scope of the appended claims. For example, in a most simplified form, the control unit could be constituted by a simple switch, enabling an unattended stove to be readily disabled by means of a switch located out of reach of small children. In another variation, the motion detector could be omitted, providing operation only in the "manual" mode described above. The switch 50 could be associated with a further long delay timer, so that if the unit was disabled, for example to allow long term unattended cooking, the device would eventually, for example after 12 hours, be re-enabled, thus avoiding inadvertent long-term disablement. In each case, however, the invention allows the stove to be temporarily disabled in a simple or automated manner from a selected location outside of the stove, and without any modification to the store itself. The sensor 38 may be replaced by any other form of sensor capable of reliably detecting the presence of absence of a person in the vicinity of the stove.

Certain aspects of the invention, as set forth above, can also be utilized in conjunction with systems built into a stove, which may have heating elements which are either electrically or gas energized, provided that electrically operable control means are available to shut off electricity or gas to elements, desirably without disabling any pilot lights provided in a gas stove.

What is claimed is:

1. A safety device for an electric cooking stove comprising a relay unit, the relay unit having a plug having two live pins and a neutral pin for insertion in a stove receptacle, a receptacle receiving a similar plug of a stove, a relay arrangement for interrupting connections between the live pins of the plug, and corresponding live sockets of the receptacle; and a control unit remote from and connected to the relay unit, the control unit including means to activate said relay arrangement; the relay arrangement is configured to interrupt only one at a time of the connections between the live pins and the live sockets, and the device further includes preset selection means to select which of said connections is interrupted.

2. A safety device according to claim 1, wherein the relay actuation means in the control unit includes a timer and means to set the timer to a predetermined elapsed time, on expiry of which the relay actuation means becomes operative.

3. A safety device according to claim 2, the control unit further including means for detecting the presence of a person in the vicinity of the stove, and means for setting the timer responsive to detecting such presence.

4. A safety device according to claim 1, wherein the control unit further includes a switch connected to disable the timer.

5. A device according to claim 1, wherein the selection means is located in the relay unit.

6. A device according to claim 5, wherein the selection means is located so as to be inaccessible when the relay unit is plugged into a stove receptacle.

7. A device according to claim 5, wherein the relay arrangement includes a relay having contacts operative to interrupt both of the connections between the live pins and live sockets, and the selection means bypasses a selected one of said contacts.

8. A device according to claim 5, wherein the relay arrangement includes a relay having a contact set, and the selection means determines which connection is interrupted by the contact set.

9. A device according to claim 1, wherein the relay arrangement includes two relays each connected to interrupt one of the connections, and the selection means selects which relay is activated.

10. A safety device for a cooking stove, comprising means to disable heating elements of the stove, a timer controlling the disablement means and operative to enable the latter after a preset interval, means to reset the timer to said preset interval, means operative to detect a person in the vicinity of the stove and connected to operate the resetting means, and switch means to enable and disable the resetting means, whereby the switch means selects one of two modes in which the device may operate, an automatic mode in which it will enable the disablement means said preset interval after the detection means sense to detect a person in the vicinity of the stove, and a manual mode in which it will turn off the stove after said preset interval.

11. A safety device according to claim 7, further including a switch to disable said timer and thus disable the safety device.

* * * * *